US010703101B2

(12) United States Patent
Ito et al.

(10) Patent No.: US 10,703,101 B2
(45) Date of Patent: Jul. 7, 2020

(54) LIQUID JETTING APPARATUS

(71) Applicant: BROTHER KOGYO KABUSHIKI KAISHA, Nagoya-shi, Aichi-ken (JP)

(72) Inventors: Yuichi Ito, Mie-ken (JP); Rui Wang, Nagoya (JP); Toru Kakiuchi, Aichi-ken (JP); Yasuo Kato, Aichi-ken (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/855,400

(22) Filed: Dec. 27, 2017

(65) Prior Publication Data

US 2018/0117914 A1 May 3, 2018

Related U.S. Application Data

(63) Continuation of application No. 15/469,787, filed on Mar. 27, 2017, now Pat. No. 9,884,483.

(30) Foreign Application Priority Data

Mar. 31, 2016 (JP) ..... 2016-071151

(51) Int. Cl.
*B41J 2/045* (2006.01)
*B41J 2/14* (2006.01)
(Continued)

(52) U.S. Cl.
CPC ..... *B41J 2/14201* (2013.01); *B41J 2/045* (2013.01); *B41J 2/055* (2013.01); *B41J 2/14233* (2013.01);
(Continued)

(58) Field of Classification Search
None
See application file for complete search history.

(56) References Cited

U.S. PATENT DOCUMENTS 5,231,422 A * 7/1993 Takeuchi ..... B41J 2/33545 346/139 C
6,098,257 A * 8/2000 Koido ..... B41J 2/1609 29/25.35
(Continued)

FOREIGN PATENT DOCUMENTS

JP 2002-287500 A 10/2002
JP 2005-238761 A 9/2005
(Continued)

OTHER PUBLICATIONS

Japanese Notice of Reasons for Refusal dated Jan. 28, 2020 received in Japanese Patent Application No. 2016-071151, together with an English-language translation.
(Continued)

*Primary Examiner* — Matthew Luu
*Assistant Examiner* — Tracey M McMillion
(74) *Attorney, Agent, or Firm* — Scully, Scott, Murphy & Presser, P.C.

(57) ABSTRACT

A liquid jetting apparatus comprises a flow passage member which has a pressure chamber communicated with a nozzle and a liquid supply port communicated with the pressure chamber; a piezoelectric element with which the flow passage member is provided so that the piezoelectric element is overlapped with the pressure chamber; a protective member which is arranged on the flow passage member so that the piezoelectric element is covered therewith; and a supply member which is formed with a supply flow passage communicated with the liquid supply port of the flow passage member and which is adhered to extend over the flow passage member and the protective member; wherein a layer of a first adhesive to adhere the protective member and the supply member is thicker than a layer of a second adhesive to adhere the flow passage member and the supply member.

13 Claims, 11 Drawing Sheets

(51) Int. Cl.
*B41J 2/055* (2006.01)
*B41J 2/16* (2006.01)

(52) U.S. Cl.
CPC ..... *B41J 2/161* (2013.01); *B41J 2/1623* (2013.01); *B41J 2002/14241* (2013.01); *B41J 2002/14362* (2013.01); *B41J 2002/14419* (2013.01); *B41J 2002/14491* (2013.01)

(56) References Cited

U.S. PATENT DOCUMENTS 9,884,483 B2 * 2/2018 Ito ..... B41J 2/14201
2005/0012785 A1 * 1/2005 Furuhata ..... B41J 2/14233 347/68
2006/0114579 A1 6/2006 Shibuya et al.
2008/0007594 A1 * 1/2008 Cha ..... B41J 2/1606 347/45
2008/0284819 A1 * 11/2008 Owaki ..... B41J 2/14233 347/44
2010/0079546 A1 4/2010 Takahashi
2014/0230870 A1 8/2014 Kondo
2014/0292936 A1 * 10/2014 Kinoshita ..... B41J 2/055 347/50
2015/0258786 A1 * 9/2015 Akahane ..... B41J 2/1433 347/65
2015/0283813 A1 10/2015 Oya
2016/0067969 A1 * 3/2016 Kakiuchi ..... B41J 2/161 347/70

FOREIGN PATENT DOCUMENTS

JP 2006-178388 A 7/2006
JP 2010-105391 A 5/2010
JP 2013-184467 A 9/2013
JP 2014-165188 A 9/2014
JP 2014-188814 A 10/2014
JP 2015-150793 A 8/2015
JP 2015-163440 A 9/2015
JP 2015-174392 A 10/2015
JP 2015-199203 A 11/2015
JP 2016-000489 A 1/2016
JP 2016-12416 A 1/2016

OTHER PUBLICATIONS

Notice of Allowance dated Oct. 6, 2017 from parent U.S. Appl. No. 15/469,787.

* cited by examiner

LIQUID JETTING APPARATUS

The present application is a continuation application of U.S. Ser. No. 15/469,787 filed on Mar. 27, 2017 and claims priority from Japanese Patent Application No. 2016-071151, filed on Mar. 31, 2016, the disclosure of each of which is incorporated herein by reference in their entirety.

BACKGROUND

Field of the Invention

The present invention relates to a liquid jetting apparatus.

Description of the Related Art

Japanese Patent Application Laid-open No. 2015-163440 discloses, as a liquid jetting apparatus, an ink-jet head which jets ink from nozzles. The ink-jet head has a flow passage forming substrate which is formed with a plurality of pressure chambers, a communication plate which is stacked on the flow passage forming substrate, a nozzle plate which is joined to the communication plate, and a plurality of piezoelectric elements which are provided on the flow passage forming substrate while corresponding to the plurality of pressure chambers.

The flow passage forming substrate is composed of, for example, a silicon single crystal substrate. The communication plate is, for example, a silicon single crystal substrate as well. However, the communication plate is the substrate which is thicker than the flow passage forming substrate. Further, the communication plate is the member which has a planar size larger than that of the flow passage forming substrate. The communication plate has its outer circumferential portion which protrudes from the flow passage forming substrate. The pressure chambers, with which the flow passage forming substrate is formed, are communicated with the nozzles of the nozzle plate via communication passages which are formed through the communication plate. A vibration plate, which covers the plurality of pressure chambers, is arranged on the flow passage forming substrate. A piezoelectric film and an electrode film are formed as films on the vibration plate, and thus the piezoelectric element is formed. Further, the communication plate is formed with a manifold which is communicated with the plurality of pressure chambers. An opening of the manifold is arranged at a protruding portion of the communication plate which protrudes from the flow passage forming substrate.

Further, the ink-jet head has a protective member which is joined to the flow passage forming substrate so that the piezoelectric elements are covered therewith, and a supply member which is provided to supply the ink to the manifold. The supply member is joined to the protruding portion of the communication plate formed with the opening of the manifold. Further, the supply member is arranged so that the supply member also extends or strides over the protective member which has a height position different from that of the communication plate, from the protruding portion of the communication plate. The supply member is joined to both of the communication plate and the protective member.

SUMMARY

In the case of the ink-jet head described in Japanese Patent Application Laid-open No. 2015-163440, the supply member is joined not only to the communication plate but also to the protective member. In this case, thin films, which are associated with the piezoelectric element, are stacked on the flow passage forming substrate, and the protective member is joined thereon. In the case of this structure, various films exist between the flow passage forming substrate and the protective member. Therefore, the height of the protective member may become higher than the designed size, on account of the accumulation of production allowable errors or tolerances thereof. If the supply member is joined while being pressed against the protective member in this state, then the large pressing force acts on the area of the formation of the piezoelectric element of the flow passage forming substrate, and it is feared that the piezoelectric element and any thin film associated therewith may be damaged.

An object of the present teaching is to suppress the pressing force from acting on a piezoelectric element via a protective member when a supply member is adhered while extending or striding over a flow passage member and the protective member.

According to an aspect of the present teaching, there is provided a liquid jetting apparatus including:

a flow passage member having a pressure chamber communicated with a nozzle and a liquid supply port communicated with the pressure chamber;

a piezoelectric element provided on the flow passage member to overlap with the pressure chamber;

a protective member arranged on the flow passage member to cover the piezoelectric element; and a supply member formed with a supply flow passage communicated with the liquid supply port of the flow passage member, and adhered to the flow passage member and the protective member to extend over the flow passage member and the protective member, wherein a thickness of a layer of a first adhesive adhering the protective member and the supply member is different from a thickness of a layer of a second adhesive adhering the flow passage member and the supply member. Note that in the liquid jetting apparatus according to the aspect of the present teaching, the layer of the first adhesive may be thicker than the layer of the second adhesive.

BRIEF DESCRIPTION OF THE DRAWINGS

FIGS. 8A to 8D depict steps of producing the head unit, wherein FIG. 8A depicts the step of forming the piezoelectric actuator, FIG. 8B depicts the step of joining the protective member and etching pressure chambers, FIG. 8C depicts the step of joining, for example, a second flow passage member, and FIG. 8D depicts the step of joining the ink supply member.

FIGS. 9A and 9B depict steps of producing the head unit, wherein FIG. 9A depicts the step of connecting COF, and FIG. 9B depicts the step of pouring a coating material.

DESCRIPTION OF THE EMBODIMENTS

Next, an embodiment of the present teaching will be explained. At first, an explanation will be made with reference to FIG. 1 about the schematic arrangement of an ink-jet printer 1. Note that with reference to FIG. 1, the direction, in which the recording paper 100 is conveyed, is defined as the front-rear direction of the printer 1. Further, the widthwise direction of the recording paper 100 is defined as the left-right direction of the printer 1. Further, the direction perpendicular to the paper surface of FIG. 1, which is orthogonal to the front-rear direction and the left-right direction, is defined as the up-down direction of the printer 1.

<Schematic Arrangement of Printer>

Figure 1:
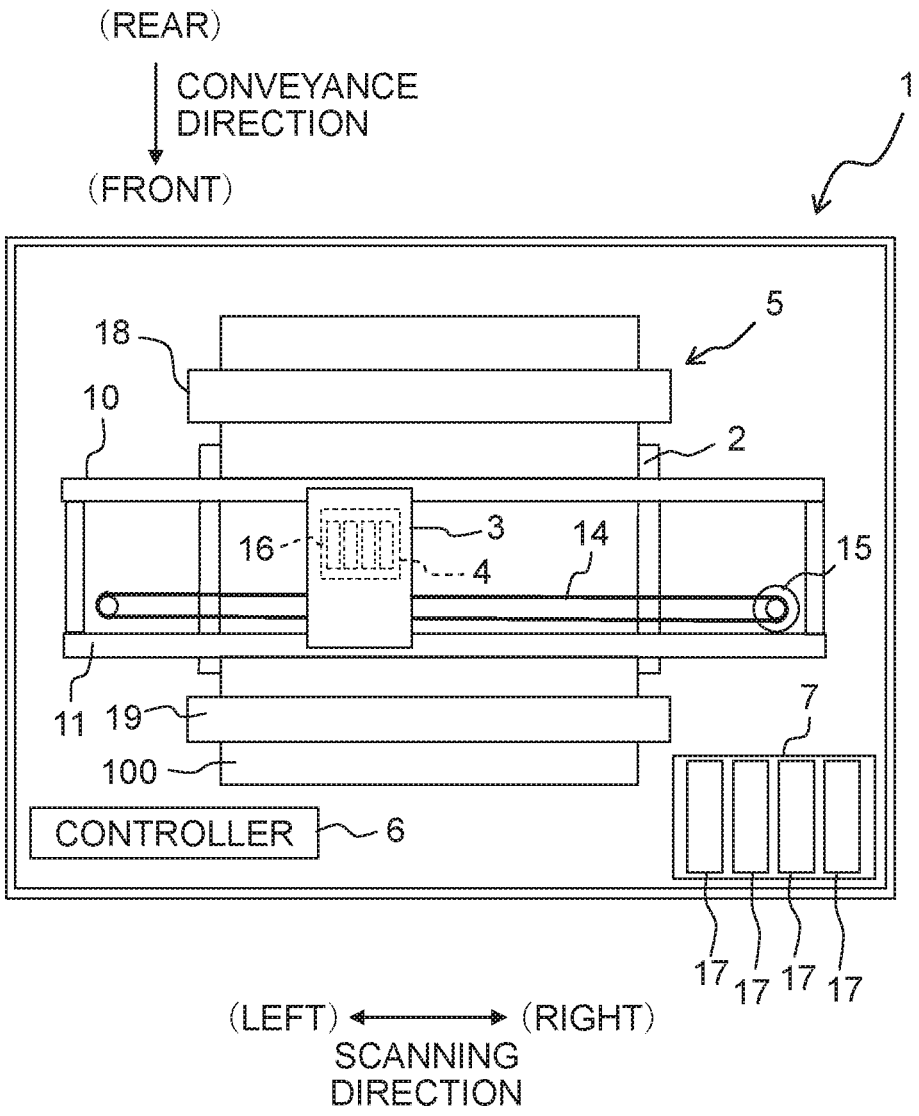
FIG. 1 depicts a schematic plan view illustrating a printer according to an embodiment of the present teaching.

As depicted in FIG. 1, the ink-jet printer 1 comprises, for example, a platen 2, a carriage 3, an ink-jet head 4, a conveyance mechanism 5, and a control device (controller) 6.

The recording paper 100, which is the recording medium subjected to the recording, is placed on the upper surface of the platen 2. The carriage 3 is constructed so that the carriage 3 is reciprocatively movable in the left-right direction (hereinafter referred to as "scanning direction" as well) along two guide rails 10, 11 in the area opposed to the platen 2. An endless belt 14 is connected to the carriage 3. The endless belt 14 is driven by a carriage driving motor 15, and thus the carriage 3 is moved in the scanning direction.

The ink-jet head 4 is attached to the carriage 3, and the ink-jet head 4 is moved in the scanning direction together with the carriage 3. The ink-jet head 4 is provided with four head units 16 which are aligned in the scanning direction. The four head units 16 are connected via unillustrated tubes respectively to a cartridge holder 7 to which ink cartridges 17 of four colors (black, yellow, cyan, and magenta) are installed.

Each of the head units 16 has a plurality of nozzles 36 (see FIGS. 4 and 5) which are formed on the lower surface thereof (surface disposed on the opposite side of the paper surface as viewed in FIG. 1). The nozzles 36 of each of the head units 16 jet the ink supplied from the ink cartridge 17 toward the recording paper 100 placed on the platen 2. Note that an explanation will be made later on about details of the head unit 16.

The conveyance mechanism 5 has two conveyance rollers 18, 19 which are arranged so that the platen 2 is interposed therebetween in the front-rear direction. The conveyance mechanism 5 conveys the recording paper 100 placed on the platen 2 in the frontward direction (hereinafter referred to as "conveyance direction" as well) by means of the two conveyance rollers 18, 19.

The control device 6 comprises, for example, ROM (Read Only Memory), RAM (Random Access Memory), and ASIC (Application Specific Integrated Circuit) which includes various control circuits. The control device 6 executes various processes including, for example, the printing on the recording paper 100, by means of ASIC in accordance with programs stored in ROM. For example, in the printing process, the control device 6 controls, for example, the ink-jet head 4 and the carriage driving motor 15 on the basis of the printing instruction inputted from an external apparatus such as PC or the like to print, for example, an image on the recording paper 100. Specifically, the ink jetting operation in which the inks are jetted while moving the ink-jet head 4 in the scanning direction together with the carriage 3 and the conveyance operation in which the recording paper 100 is conveyed by a predetermined amount in the conveyance direction by means of the conveyance rollers 18, 19 are alternately performed.

<Details of Head Unit>

Next, an explanation will be made in detail about the construction of the head unit 16 of the ink-jet head 4. Note that the four head units 16 are constructed identically respectively. Therefore, in the following description, one of the four head units 16 will be explained.

As depicted in FIGS. 2 to 6, the head unit 16 comprises, for example, a first flow passage member 21, a second flow passage member 22, a nozzle plate 23, a piezoelectric actuator 24, COF (Chip On Film) 25, a protective member 26, and an ink supply member 27. Note that in FIGS. 2 to 4, COF 25, which extends upwardly while passing through a hole 26*b* of the protective member 26 and a hole 27*b* of the ink supply member 27, is omitted from the illustration.

<First Flow Passage Member, Second Flow Passage Member, Nozzle Plate>

At first, an explanation will be made about the first flow passage member 21, the second flow passage member 22, and the nozzle plate 23. The three members described above have rectangular planar shapes respectively, and they are stacked in the vertical direction in an order of the first flow passage member 21, the second flow passage member 22, and the nozzle plate 23 as referred to from the top. A silicon single crystal substrate is used for the first flow passage member 21 in view of the formation of piezoelectric elements 41 as described later on in accordance with a film formation process on the first flow passage member 21. On the other hand, materials of the second flow passage member 22 and the nozzle plate 23 are not limited to the silicon single crystal substrate. The second flow passage member 22 and the nozzle plate 23 may be formed, for example, with a metal or a resin. However, in view of the prevention of the warpage and the crack to be caused by the heat, it is preferable that the second flow passage member 22 and the nozzle plate 23 are also formed of the same material as that of the first flow passage member 21, i.e., the silicon single crystal substrate.

The first flow passage member 21 is formed with a plurality of pressure chambers 28 which are arranged in a planar form along the horizontal plane. Each of the pressure chambers 28 has a rectangular planar shape which is long in the scanning direction. The plurality of pressure chambers 28 are arranged in the conveyance direction to form two pressure chamber arrays which are aligned in the scanning direction. Further, the positions of the pressure chambers 28 in the conveyance direction are different from each other between the two pressure chamber arrays. More specifically, assuming that P represents the arrangement interval of the pressure chambers 28 in each of the pressure chamber arrays, the positions of the pressure chambers 28 in the conveyance direction are deviated by every P/2 between the two left and right pressure chamber arrays.

Figure 7:
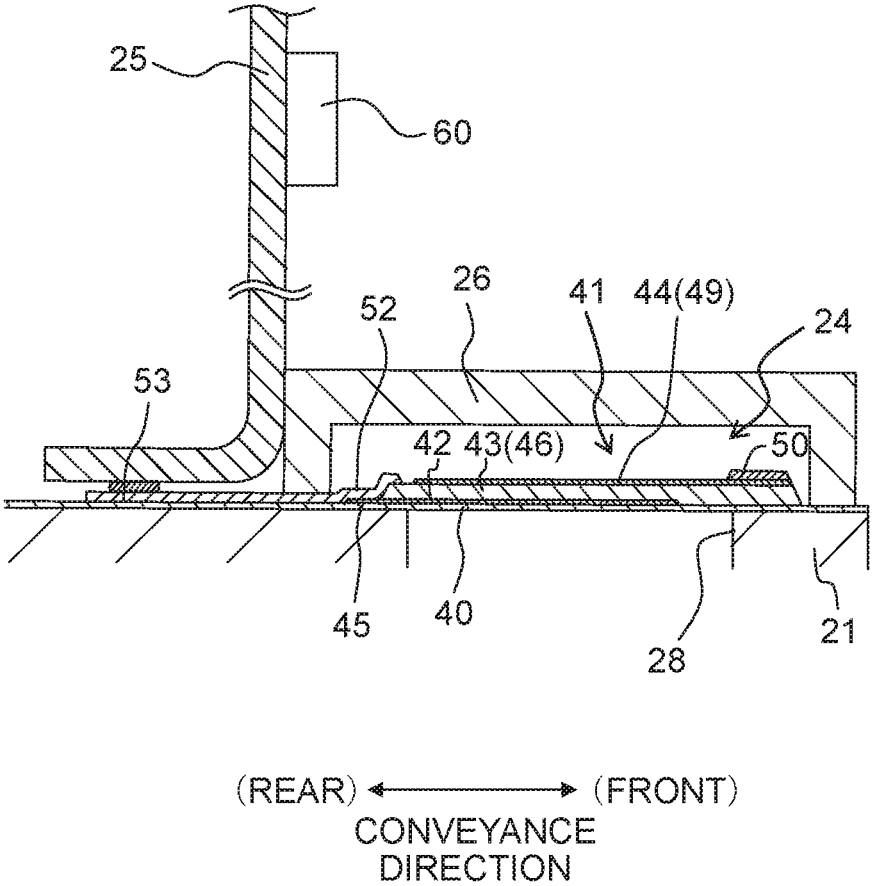
FIG. 7 depicts a partial magnified view illustrating a piezoelectric actuator depicted in FIG. 5.

As depicted in FIG. 7, a vibration film 40 of the piezoelectric actuator 24 described later on is formed on the upper surface of the first flow passage member 21. The plurality of pressure chambers 28 are covered with the vibration film 40.

The vibration film 40 is, for example, a film of silicon dioxide which is formed by oxidizing the surface of the silicon single crystal substrate for constructing the first flow passage member 21.

Figure 4:
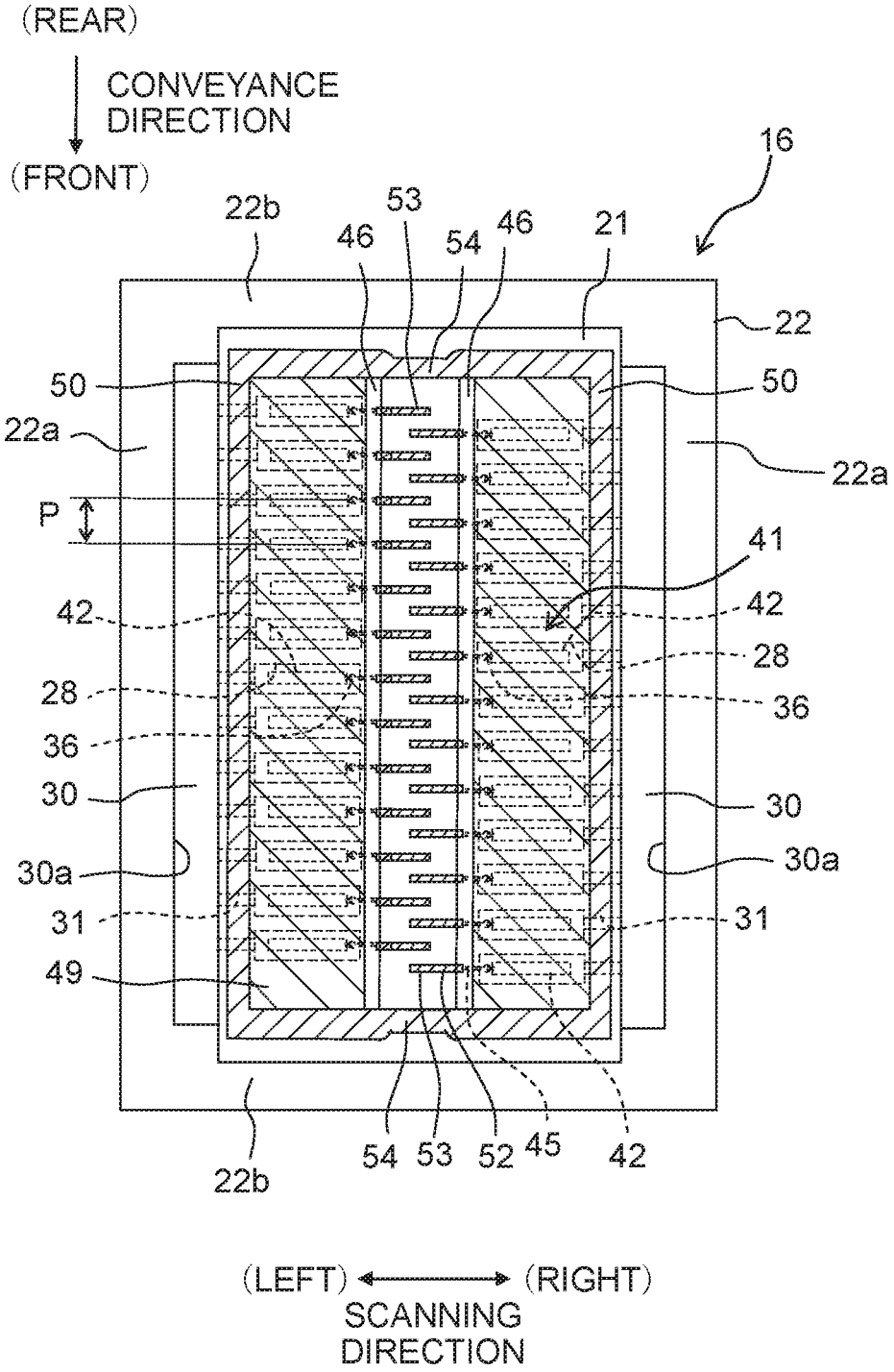
FIG. 4 depicts a plan view illustrating the head unit, in which the ink supply member and a protective member are omitted.
Figure 5:
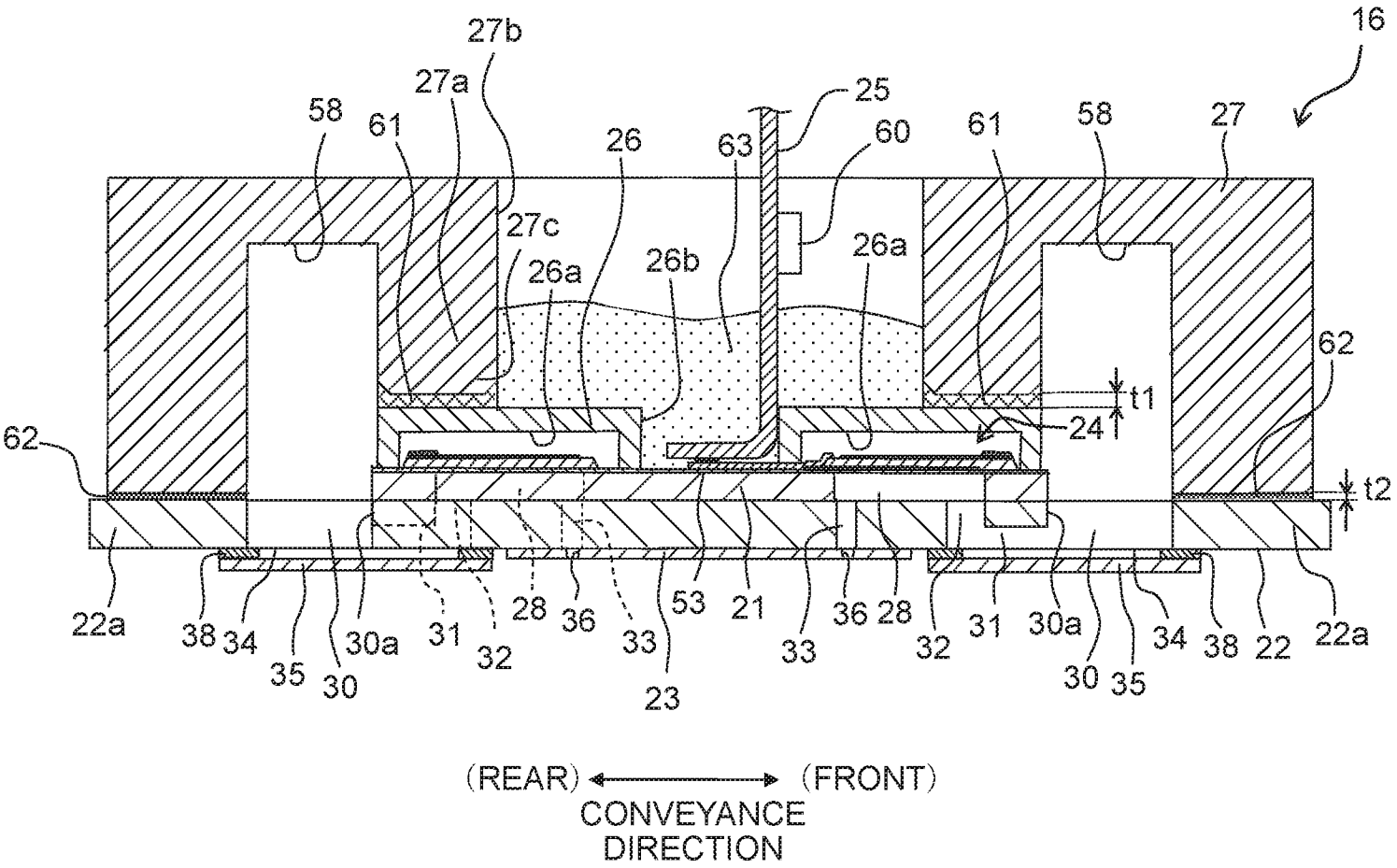
FIG. 5 depicts a sectional view taken along a line V-V depicted in FIG. 2.

The second flow passage member 22 is arranged on the lower side of the first flow passage member 21. As depicted in FIGS. 4 and 5, the second flow passage member 22 has a planar shape which is one size larger than that of the first flow passage member 21. The second flow passage member 22 has its edge portion which protrudes to the outer side as compared with the first flow passage member 21 over the entire circumference. In other words, the second flow passage member 22 has two first protruding portions 22*a* which protrude leftwardly and rightwardly and two second protruding portions 22*b* which protrude frontwardly and backwardly with respect to the first flow passage member 21.

As depicted in FIGS. 4 and 5, two manifolds 30, which extend in the conveyance direction while corresponding to the two pressure chamber arrays respectively, are formed at the two left and right first protruding portions 22*a* of the second flow passage member 22 respectively. That is, openings 30*a* of the respective manifolds 30 are exposed from the first flow passage member 21. The ink is supplied from one ink cartridge 17 to the two manifolds 30 by the aid of the ink supply member 27 as described later on. That is, in this embodiment, the ink of an identical color is supplied to the two manifolds 30.

Further, the second flow passage member 22 is formed with throttle flow passages 31 which extend inwardly in the left-right direction from the manifold and communication passages 32 which connect the throttle flow passages 31 and the pressure chambers 28. Each of the pressure chambers 28 is communicated with the corresponding manifold 30 via the communication passage 32 and the throttle flow passage 31. Further, the second flow passage member 22 is also formed with communication passages 33 which communicate the respective pressure chambers 28 with the nozzles 36 of the nozzle plate 23 as described later on.

A flexible damper film 34 is joined to the lower surface of the second flow passage member 22 so that each of the manifolds 30 is covered therewith. The damper film 34 is provided in order to attenuate the pressure fluctuation of the ink in each of the manifolds 30. A protective plate 35 is arranged under the damper film 34 with a frame-shaped spacer 38 made of metal intervening therebetween. The damper film 34 is protected by the protective plate 35 which is arranged while providing a gap with respect to the damper film 34.

The nozzle plate 23 is formed with the plurality of nozzles 36 which correspond to the plurality of pressure chambers 28 respectively. The respective nozzles 36 are communicated with the pressure chambers 28 of the first flow passage member 21 via the communication passages 33 which are formed for the second flow passage member 22. The plurality of nozzles 36 are arranged in two arrays in accordance with the arrangement of the pressure chambers. The positions of the nozzles 36 in the conveyance direction are also deviated by every P/2 between the two nozzle arrays in the same manner as the pressure chamber arrays 29 described above.

<Piezoelectric Actuator>

Next, an explanation will be made about the piezoelectric actuator 24. As depicted in FIG. 7, the piezoelectric actuator 24 is arranged above the first flow passage member 21. The piezoelectric actuator 24 has the vibration film 40 and the plurality of piezoelectric elements 41 which are arranged on the vibration film 40.

As described above, the vibration film 40 is formed on the upper surface of the first flow passage member 21, and the plurality of pressure chambers 28 are covered therewith. The thickness of the vibration film 40 is, for example, 1.0 to 1.5 μm. The plurality of piezoelectric elements 41 are arranged respectively at the positions on the upper surface of the vibration film 40 overlapped with the plurality of pressure chambers 28. The plurality of piezoelectric elements 41 form two piezoelectric element arrays which are aligned in the scanning direction in the same manner as the pressure chambers 28.

An explanation will be made about the construction of the individual piezoelectric element 41. Each of the piezoelectric elements 41 has a lower electrode 42 which is arranged on the vibration film 40, a piezoelectric film 43 which is arranged on the lower electrode 42, and an upper electrode 44 which is arranged on the piezoelectric film 43.

The lower electrode 42 is arranged on the upper surface of the vibration film 40 so that the lower electrode 42 is overlapped with the pressure chamber 28. The lower electrode 42 is the so-called individual electrode to which the driving signal is individually supplied from driver IC 60 as described later on. A leading portion 45 is led from an inner end portion of the lower electrode 42 in the scanning direction. The lower electrode 42 and the leading portion 45 are formed of, for example, platinum (Pt). Further, the thickness of each of them is, for example, 0.1 μm.

The piezoelectric film 43 is formed of a piezoelectric material such as lead titanate zirconate (PZT) or the like. The thickness of the piezoelectric film 43 is, for example, 1.0 to 2.0 μm. As depicted in FIGS. 3 to 6, in this embodiment, the piezoelectric film 43 of the piezoelectric element 41 corresponding to the pressure chamber array disposed on the left side is linked, and the piezoelectric film 43 of the piezoelectric element 41 corresponding to the pressure chamber array disposed on the right side is also linked. In other words, two piezoelectric members 46, i.e., a piezoelectric member 46 which covers the pressure chamber array disposed on the left side and a piezoelectric member 46 which covers the pressure chamber array disposed on the right side are arranged on the vibration film 40.

As depicted in FIGS. 4 and 7, the leading portion 45, which is connected to the lower electrode 42, extends inwardly in the scanning direction from the lower electrode 42, and the end portion thereof is exposed from the piezoelectric member 46. A wiring 52 described later on is connected to the end portion of each of the leading portions 45 exposed from the piezoelectric member 46.

The upper electrode 44 is arranged on the upper surface of the piezoelectric film 43. The upper electrode 44 is formed of, for example, iridium. Further, the thickness of the upper electrode 44 is, for example, 0.1 μm. The upper electrodes 44, which correspond to the plurality of pressure chambers 28, are linked to one another on the upper surface of the piezoelectric member 46, and thus a common electrode 49, which covers the substantially entire region of the upper surface of the piezoelectric member 46, is constructed. Note that the ground electric potential is applied to the upper electrode 44 (common electrode 49) by means of COF 25 as described later on.

An auxiliary conductor 50 is provided on the common electrode 49. As depicted in FIG. 4, the auxiliary conductor 50 is stacked on the common electrode 49 on edge portions disposed on the outer sides in the left-right direction of the piezoelectric member 46 and on two edge portions disposed on the both sides in the front-rear direction. The auxiliary conductor 50 is not provided on the edge portions disposed on the inner sides in the left-right direction. The auxiliary conductor 50 is formed of, for example, gold (Au). Further, the thickness of the auxiliary conductor 50 is larger than the thickness of the common electrode 49.

As described above, the leading portion 45, which is connected to the lower electrode 42, extends inwardly in the scanning direction from the lower electrode 42, and the leading portion 45 is exposed from the piezoelectric member 46. The wiring 52 is connected to the exposed end portion of the leading portion 45. Each of the wirings 52 extends inwardly in the scanning direction from the corresponding end portion of the leading portion 45. The wiring 52 is formed of, for example, gold (Au), and the wiring 52 can be formed in accordance with the same film formation process as that for the auxiliary conductor 50.

As depicted in FIG. 4, a plurality of driving contacts 53 and two ground contacts 54 are arranged in an area disposed between the two piezoelectric element arrays of the vibration film 40. The plurality of driving contacts 53 are arranged in one array in the conveyance direction. The two ground contacts 54 are arranged while being separated on the upstream side and the downstream side in the conveyance direction with respect to the array of the driving contacts 53 so that the plurality of driving contacts 53 are interposed in the conveyance direction. The plurality of wirings 52 are connected to the plurality of driving contacts 53 respectively. Further, the auxiliary conductor 50 is connected to the two ground contacts 54.

<Protective Member>

Figure 2:
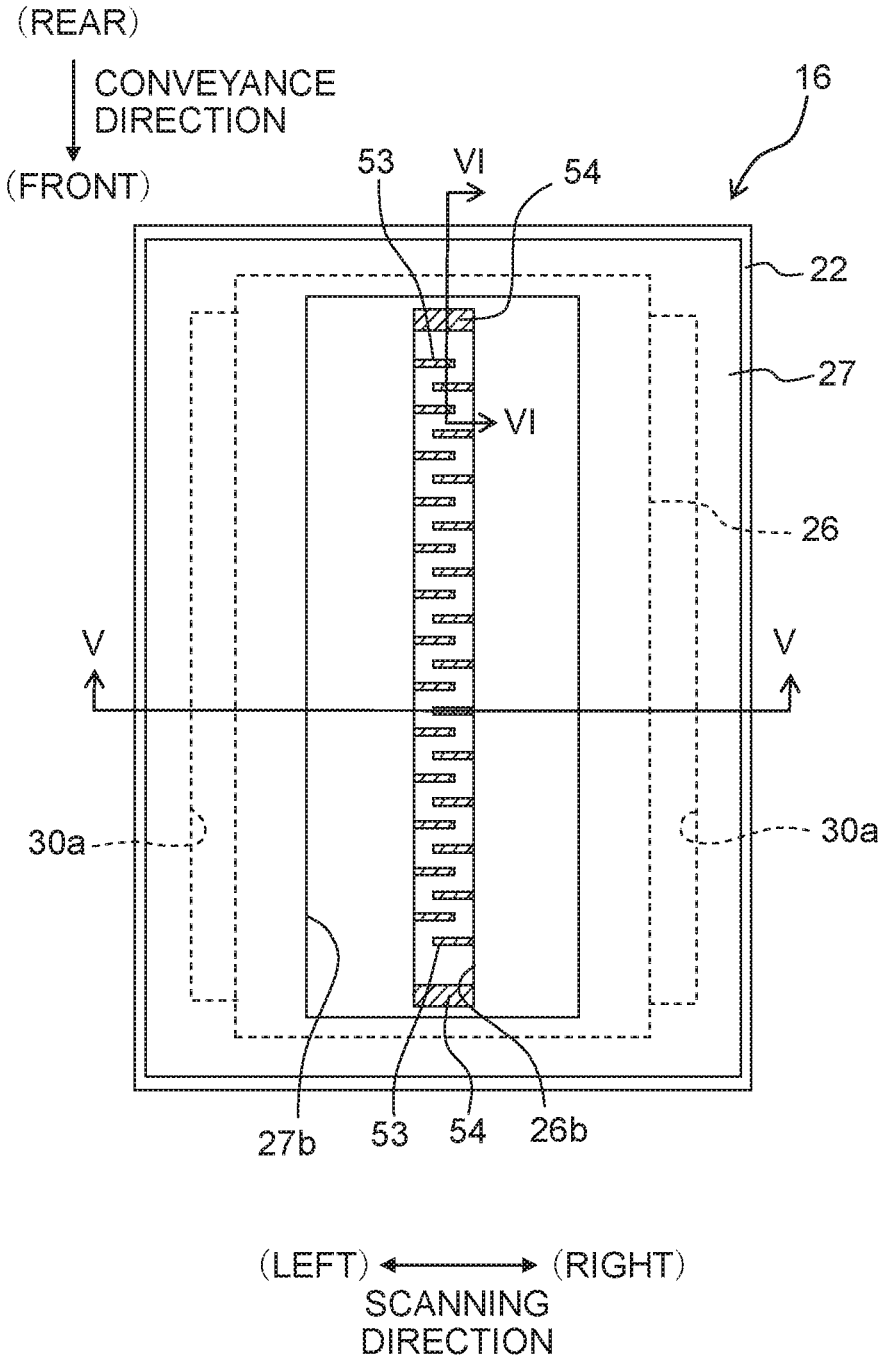
FIG. 2 depicts a plan view illustrating a head unit.
Figure 3:
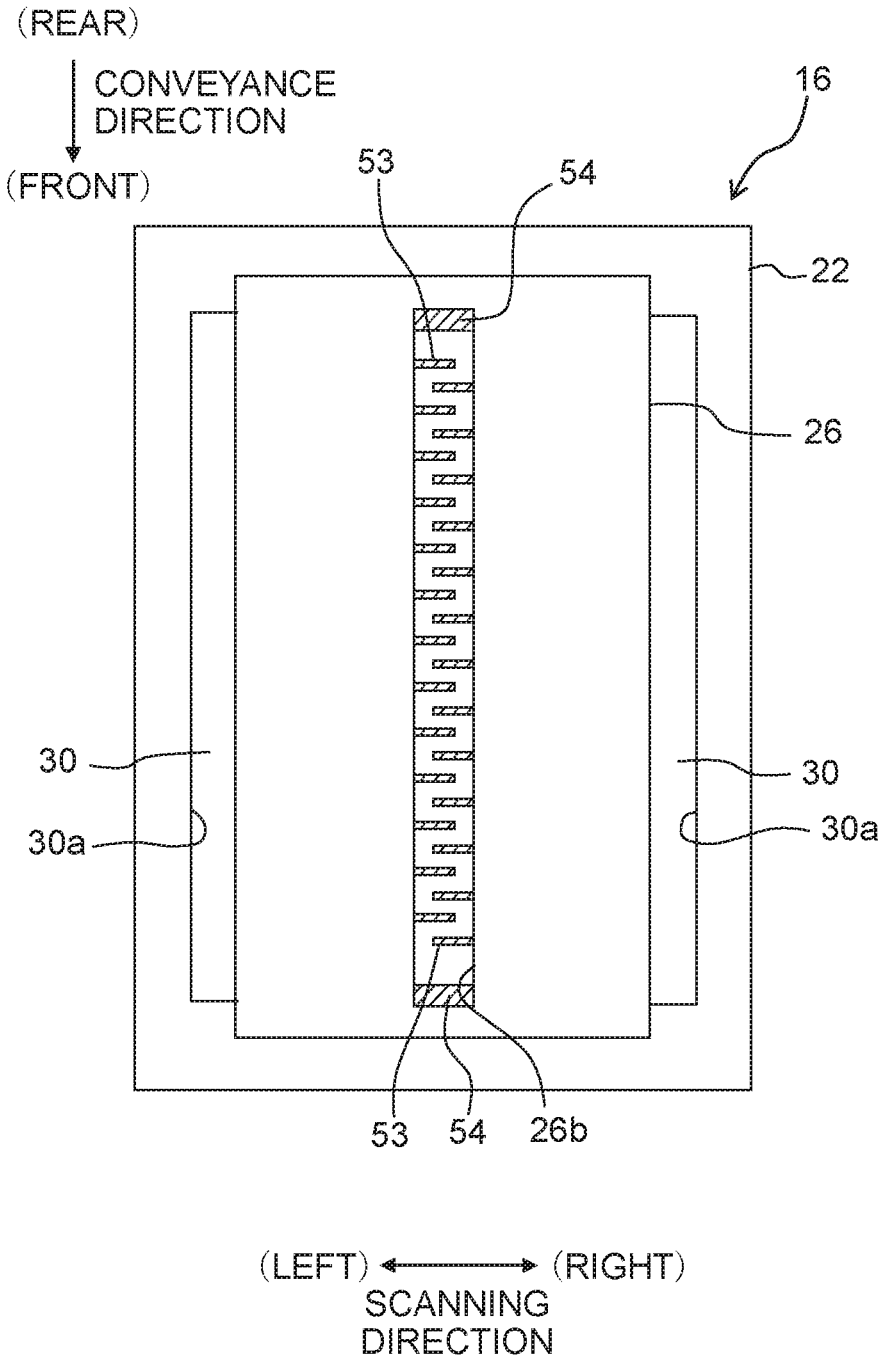
FIG. 3 depicts a plan view illustrating the head unit, in which an ink supply member is omitted.

As depicted in FIGS. 2 and 5, the protective member 26 is arranged on the upper side of the first flow passage member 21 so that the plurality of piezoelectric elements 41 are covered therewith. Specifically, the protective member 26 is joined with an adhesive on the piezoelectric actuator 24 having the structure in which various films including, for example, the vibration film 40 and the piezoelectric film 43 are stacked.

The protective member 26 has two left and right recessed cover portions 26*a* and a hole 26*b* which is formed between the two cover portions 26*a*. In the state in which the protective member 26 is arranged on the first flow passage member 21, the left cover portion 26*a* covers the left piezoelectric element array, and the right cover portion 26*a* covers the right piezoelectric element array. Further, the plurality of driving contacts 53 and the two ground contacts 54 are exposed from the hole 26*b*. Note that the material of the protective member 26 is not specifically limited, but it is possible to preferably adopt those formed of silicon.

<COF>

As described above, the plurality of driving contacts 53 and the two ground contacts 54 are arranged in the front-rear direction in the area disposed between the two left and right piezoelectric element arrays of the vibration film 40. Then, COF 25, which is the wiring member, is joined to the area of the vibration film 40, and COF 25 is electrically connected to the plurality of driving contacts 53 and the two ground contacts 54. The end portion of COF 25, which is disposed on the side opposite to the first flow passage member 21, is connected to the control device 6 (see FIG. 1).

The driver IC 60 is provided at an intermediate portion in the up-down direction of the COF 25. The driver IC 60 is electrically connected to the control device 6 via the wiring (not depicted) formed in the COF 25. Further, the driver IC 60 is also electrically connected to the plurality of driving contacts 53 via the wiring in the COF 25. Then, the driver IC 60 outputs the driving signal to the lower electrode 42 connected to the driving contact 53 on the basis of the control signal fed from the control device 6 so that the electric potential of the lower electrode 42 is switched between the ground electric potential and the predetermined driving electric potential. Note that the ground contact 54 is electrically connected to the ground wiring (not depicted) formed in COF 25, and the upper electrode 44, which constitutes the common electrode 49, is retained at the ground electric potential.

An explanation will be made about the operation of each of the piezoelectric elements 41 to be performed when the driving signal is supplied from the driver IC 60 to the lower electrode 42. In the state in which the driving signal is not supplied, the electric potential of the lower electrode 42 is the ground electric potential, which is the same electric potential as that of the upper electrode 44. Starting from this state, when the driving signal is supplied to a certain lower electrode 42, and the driving electric potential is applied to the lower electrode 42, then the electric potential difference is generated between the lower electrode 42 and the upper electrode 44, and the electric field, which is parallel to the thickness direction, acts on the piezoelectric film 43. The electric field allows the piezoelectric film 43 to elongate in the thickness direction and shrink in the in-plane direction. As a result, the vibration film 40, which covers the pressure chamber 28, is warped or flexibly bent so that the vibration film 40 protrudes toward side of the pressure chamber 28. Accordingly, the volume of the pressure chamber 28 is decreased, and the pressure wave is generated in the pressure chamber 28. Thus, the liquid droplets of the ink are jetted from the nozzle 36 which is communicated with the pressure chamber 28.

<Ink Supply Member>

As depicted in FIG. 2, the ink supply member 27 has a rectangular planar shape which has approximately the same size as that of the second flow passage member 22, and the ink supply member 27 is arranged over the second flow passage member 22 and the protective member 26. The material of the ink supply member 27 is not specifically limited. However, the ink supply member 27 is formed of, for example, a synthetic resin. As depicted in FIGS. 2 and 5, a hole 27*b*, which is overlapped with the hole 26*b* of the protective member 26 and which has a width larger than that of the hole 26*b*, is formed at a central portion of the ink supply member 27 in the scanning direction. As depicted in FIG. 5, COF 25, which is connected to the piezoelectric actuator 24, extends upwardly while passing through the hole 26*b* of the protective member 26 and the hole 27*b* of the ink supply member 27.

The ink supply member 27 is connected to the holder 7 (see FIG. 1) to which the ink cartridge 17 is installed. An ink supply flow passage 58 is formed in the ink supply member 27. The lower end of the ink supply flow passage 58 is communicated with the manifold 30 which is formed at the first protruding portion 22*a* of the second flow passage member 22. Owing to this structure, the ink, which is contained in the ink cartridge 17 installed to the holder 7, is supplied to the manifold 30 of the second flow passage member 22 via the ink supply flow passage 58 of the ink supply member 27.

The lower surface of the outer circumferential portion of the ink supply member 27 is adhered with a second adhesive 62 to the first protruding portion 22*a* and the second protruding portion 22*b* of the outer circumferential portion of the second flow passage member 22. Further, the entire circumference of the edge portion 27*a* of the hole 27*b* of the ink supply member 27 is vertically overlapped with the protective member 26. The lower surface of the edge portion 27*a* is adhered with a first adhesive 61 to the upper surface of the protective member 26. That is, as depicted in FIG. 5, in the scanning direction, the ink supply member 27 is adhered while extending over from the upper surface of the first protruding portion 22*a* of the second flow passage member 22 to the upper surface of the protective member 26 which is disposed at the position higher than the above. Further, as depicted in FIG. 6, in the conveyance direction, the ink supply member 27 is also adhered while extending over from the second protruding portion 22*b* of the second flow passage member 22 to the protective member 26.

In this way, the ink supply member 27 is joined while extending over not only the second flow passage member 22 but also the protective member 26 which covers the piezoelectric element 41. If the ink supply member 27 is adhered to only the second flow passage member 22, it is necessary to secure an area in which the edge portion 27*a* of the hole 27*b* of the ink supply member 27 is adhered on the outer side of the protective member 26. On the contrary, with reference to FIGS. 5 and 6 of this embodiment, the edge portion 27*a* is vertically overlapped with the protective member 26, and the edge portion 27*a* is adhered to the upper surface of the protective member 26. Accordingly, it is possible to decrease the planar size of the second flow passage member 22, and it is possible to miniaturize the head unit 16. In particular, in this embodiment, the ink supply member 27 is adhered while extending over from the second flow passage member 22 to the protective member 26 at both of the end portion in the left-right direction (see FIG. 5) and the end portion in the front-rear direction (see FIG. 6). Accordingly, it is possible to miniaturize the size of the head unit 16 in both of the front-rear direction and the left-right direction.

However, the protective member 26 is installed in the arrangement area of the first flow passage member 21 for arranging the piezoelectric element 41. On this account, when the ink supply member 27 is adhered to the protective member 26, if the ink supply member 27 is pressed against the protective member 26 to heat and cure the adhesives 61, 62, then it is feared that a part of the pressing force may act on the arrangement area of the piezoelectric element 41 via the protective member 26. In particular, in this embodiment, various thin films, which include, for example, the vibration film 40 and the piezoelectric film 43, are stacked on the first flow passage member 21, and the protective member 26 is adhered thereon. In the case of this structure, the height of the protective member 26 may be higher than the designed dimension by accumulating the production allowable errors (tolerances) in relation to the various thin films as described above. In such a situation, if the ink supply member 27 is adhered to the protective member 26 while pressing the ink supply member 27 against the protective member 26, it is feared that a large force may act on the area of the first flow passage member 21 for forming the piezoelectric element 41, and the thin films for constructing the piezoelectric actuator 24 may be damaged.

Figure 6:
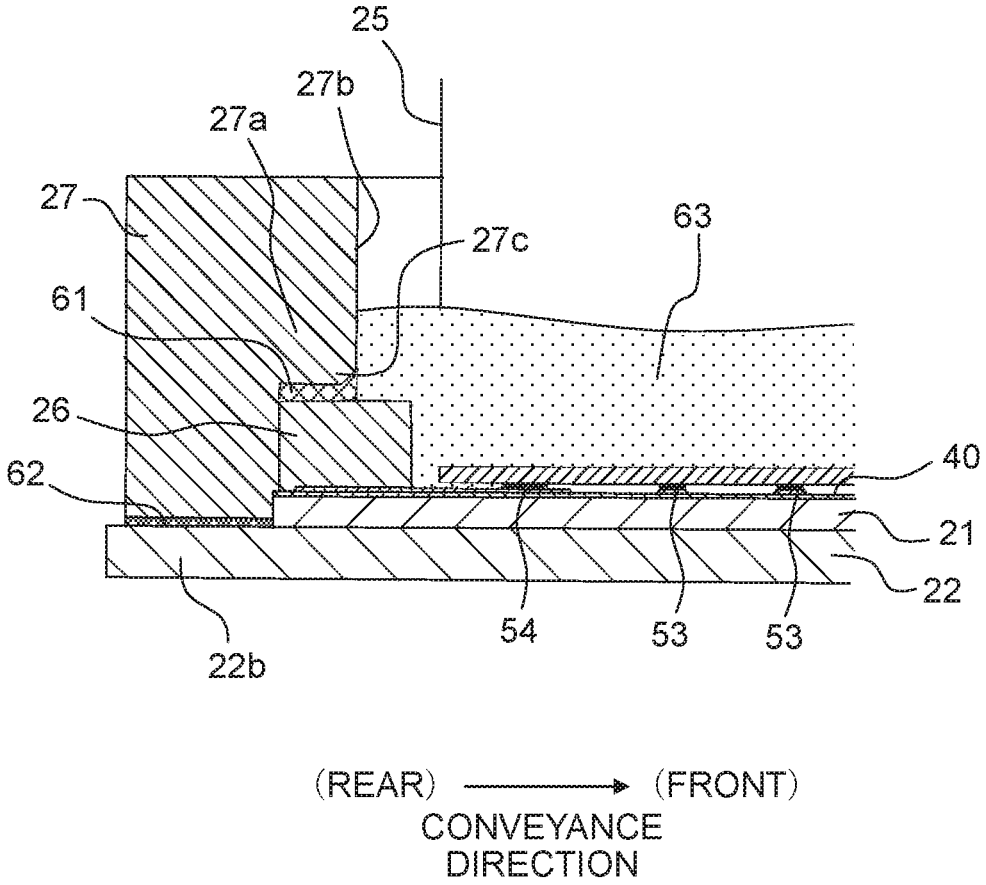
FIG. 6 depicts a sectional view taken along a line VI-VI depicted in FIG. 2.

In view of the above, in this embodiment, as depicted in FIGS. 5 and 6, the thickness t1 of the layer of the first adhesive 61 for adhering the ink supply member 27 and the protective member 26 is thicker than the thickness t2 of the layer of the second adhesive 62 for adhering the ink supply member 27 and the second flow passage member 22. In the case of this structure, when the ink supply member 27 is pressed, the ink supply member 27 is strongly pressed against the second flow passage member 22 via the thin layer of the second adhesive 62. In other words, the force hardly acts on the protective member 26. Therefore, it is possible to prevent the thin films of the piezoelectric actuator 24 from being damaged.

Note that the thickness of the layer of the first adhesive 61 is preferably not less than 5 μm in order to decrease the force acting on the protective member 26. On the other hand, it is appropriate that the thickness of the layer of the second adhesive 62 is 1 μm to 3 μm so that the ink supply member 27 and the second flow passage member 22 can be reliably adhered.

Note that the head unit 16 of this embodiment has the first flow passage member 21 which is formed with the pressure chambers 28 and the second flow passage member 22 which is formed with the manifolds 30, as the flow passage members to which the ink is supplied from the ink supply member 27. In this case, the first flow passage member 21 is the substrate in which the thin films are formed in accordance with various film formation processes and the plurality of piezoelectric elements 41 are formed on the upper surface thereof. The production cost of the first flow passage member 21 is apt to increase. Therefore, as for the first flow passage member 21, it is preferable that the planar size thereof is decreased to be as small as possible so that a larger number of the first flow passage members 21 can be cut out from one sheet of silicon wafer.

On the other hand, as for the second flow passage member 22, the film formation process for the piezoelectric element 41 is not applied unlike the first flow passage member 21. The production cost of the second flow passage member 22 is lower than that of the first flow passage member 21. In view of the above, in this embodiment, the size of the first flow passage member 21 is decreased, while the second flow passage member 22 is the member having the planar size which is larger than that of the first flow passage member 21. On this assumption, the ink supply member 27 is adhered to the protruding portions 22*a*, 22*b* of the second flow passage member 22 protruding from the first flow passage member 21. Further, the second flow passage member 22 is the member in which the manifold 30 having the large volume is formed, and hence the second flow passage member 22 is required to have a certain extent of thickness. That is, the second flow passage member 22 is necessarily the member having the rigidity which is higher than that of the first flow passage member 21. According to this fact as well, it is affirmed that the second flow passage member 22 is suitable as compared with the first flow passage member 21 as the object against which the ink supply member 27 is strongly pressed.

Further, in relation to the adhesion of the ink supply member 27, the following constructions are further adopted for the head unit 16 of this embodiment.

In relation to the adhesion surface between the protective member 26 and the ink supply member 27 to be adhered by the first adhesive 61, it is also allowable that the surface roughness is rougher than that of the adhesion surface between the second flow passage member 22 and the ink supply member 27 to be adhered by the second adhesive 62. Note that the "adhesion surface" referred to herein is the concept which includes not only the adhesion surface disposed on the side of the ink supply member 27 but also the adhesion surfaces of the protective member 26 and the second flow passage member 22 as the adhesion objects with respect to the ink supply member 27.

Specifically, the adhesion surface of the ink supply member 27 with respect to the protective member 26 is rougher than the adhesion surface of the ink supply member 27 with respect to the second flow passage member 22. Alternatively, it is also allowable that the surface roughness of the upper surface of the protective member 26 is rougher than the surface roughness of the upper surface of the second flow passage member 22. When the surface roughness of the adhesion surface between the protective member 26 and the ink supply member 27 is rough as described above, the first adhesive 61, which adheres to the adhesion surface, hardly spreads but the first adhesive 61 bulges owing to the protrusions and recesses of the surface thereof. Therefore, it is easy to increase the thickness of the layer of the first adhesive 61. Specifically, the surface roughness Ra of the adhesion surface of the ink supply member 27 with respect to the protective member 26 is not less than 1.0 μm, and the surface roughness Ra of the adhesion surface of the ink supply member 27 with respect to the second flow passage member 22 is less than 1.0 μm. Note that when both of the protective member 26 and the second flow passage member 22 are the silicon single crystal substrates, the surface roughness Ra of the adhesion surface disposed on the side of the two members is less than 1.0 nm. Therefore, in order to suppress the spread of the first adhesive 61, it is appropriate that the first adhesive 61 is applied to the adhesion surface disposed on the side of the ink supply member 27.

Note that it is possible to adopt, for example, the etching, the polishing, and the blast as the method for obtaining the different surface roughnesses of the adhesion surfaces at the two adhesion portions. Further, it is also allowable that the protective member 26 and the second flow passage member 22 are formed of materials having different surface roughnesses respectively.

If the layer of the first adhesive 61 is thick, then the pressing force, which is exerted when the ink supply member 27 is adhered, hardly acts on the protective member 26, while a large force acts on the second flow passage member 22 to an extent corresponding thereto. In relation to this matter, as depicted in FIGS. 5 and 6, the areal size of the adhesion surface between the second flow passage member 22 and the ink supply member 27 is larger than the areal size of the adhesion surface between the protective member 26 and the ink supply member 27. For example, the width in the left-right direction of the adhesion surface between the second flow passage member 22 and the ink supply member 27 is 1.0 mm, and the width in the left-right direction of the adhesion surface between the protective member 26 and the ink supply member 27 is 0.5 mm. Accordingly, any locally large force is suppressed from acting on the second flow passage member 22. Therefore, the second flow passage member 22 is prevented from being damaged.

As depicted in FIGS. 5 and 6, the driving contacts 53 connected to the piezoelectric elements 41 and the ground contacts 54 are arranged in the area of the first flow passage member 21 exposed from the hole 26*b* of the protective member 26, and COF 25 is connected to the contacts 53, 54. Further, the adhesion portions between the protective member 26 and the ink supply member 27 are arranged at the positions adjacent in the left-right direction and the front-rear direction with respect to the area in which the contacts 53, 54 are arranged.

In this case, the layer of the first adhesive 61 is not strongly pressed when the ink supply member 27 is adhered. Therefore, the ink sealing performance, which is provided at the adhesion portion brought about by the first adhesive 61, becomes low. In the worst case, if the ink leaks from the adhesion portion, it is feared that any short circuit may be formed at the connecting portions between COF 25 and the contacts 53, 54 adjacent to the protective member 26. In view of the above, as depicted in FIGS. 5 and 6, an insulative coating material 63 is poured or injected into the hole 27*b* of the ink supply member 27, and the connecting portions between COF and the contacts 53, 54 are covered with the coating material 63. Further, the adhesion portion brought about by the first adhesive 61 is also covered with the coating material 63. Accordingly, even if the ink leaks from the adhesion portion brought about by the first adhesive 61, then the ink does not arrive at the connecting portions between COF 25 and the contacts 53, 54, and the short circuit is prevented from being formed. Note that it is possible to use, as the coating material 63, any potting material based on silicon or based on epoxy.

If the ink supply member 27 is adhered to the protective member 26 in a slightly inclined posture or attitude, it is feared that the corner 27*c* of the ink supply member 27 may abut against the protective member 26, and the protective member 26 may be wounded. In view of the above, as depicted in FIGS. 5 and 6, it is preferable that the corner 27*c* of the ink supply member 27, which is disposed at the portion to be joined to the protective member 26, is chamfered, and the corner 27*c* is not sharpened.

Next, an explanation will be made with reference to FIGS. 8 and 9 about a method for producing the head unit 16 described above.

Figure 8A:
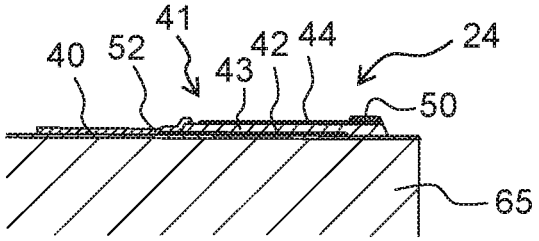

At first, as depicted in FIG. 8A, the vibration film 40, the lower electrode 42, the piezoelectric film 43, the upper electrode 44, the wiring 52, and the auxiliary conductor 50 are successively stacked in accordance with any appropriate film formation method on the surface of the silicon single crystal substrate 65 which serves as the first flow passage member 21, and thus the piezoelectric actuator 24 having the piezoelectric elements 41 is formed.

Figure 8B:
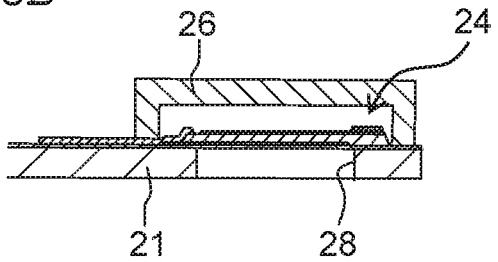
Figure 8C:
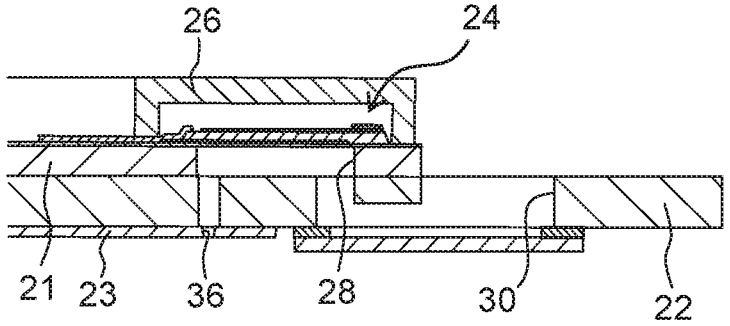

Subsequently, as depicted in FIG. 8B, the protective member 26 is adhered to the substrate 65 so that the piezoelectric elements 41 are covered therewith. After the adhesion of the protective member 26, the substrate 65 is polished until a predetermined thickness is obtained so that the first flow passage member 21 is prepared. Further, the etching is applied from the lower surface to the first flow passage member 21 to form the pressure chambers 28. After that, as depicted in FIG. 8C, the second flow passage member 22 and the nozzle plate 23 are joined to the first flow passage member 21 which is formed with the pressure chambers 28.

Figure 8D:
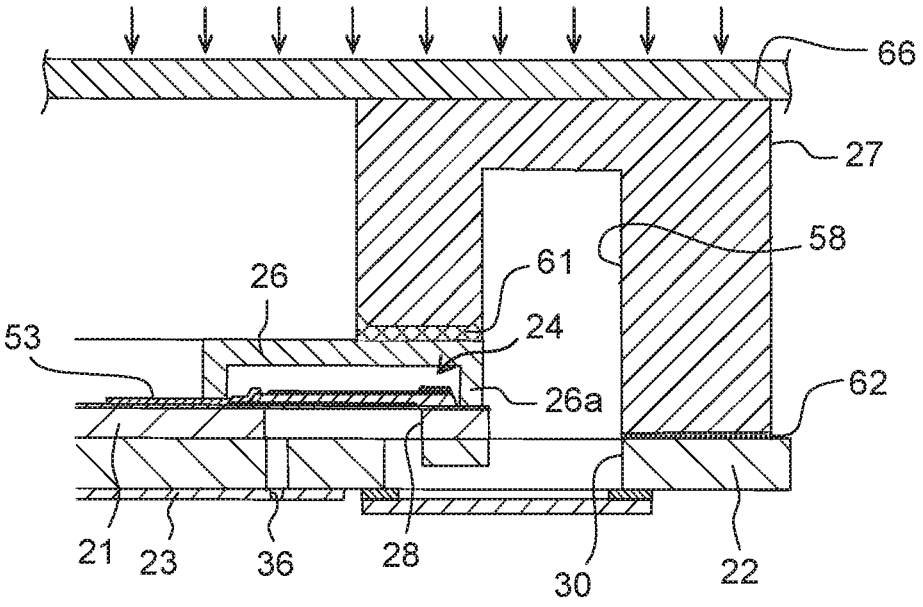

Subsequently, as depicted in FIG. 8D, the ink supply member 27 is adhered to extend over the second flow passage member 22 and the protective member 26. Specifically, the first adhesive 61 in a liquid state is applied to the lower surface of the ink supply member 27 which is to be adhered to the protective member 26. On the other hand, an adhesive sheet, which serves as the second adhesive 62, is stuck to the adhesion surface of the ink supply member 27 with respect to the second flow passage member 22. Note that the application thickness of the first adhesive 61 in the liquid state is preferably increased depending on the number of films and members existing between the second flow passage member 22 and the adhesion portion brought about by the first adhesive 61. Specifically, the ink supply member 27 and the second flow passage member 22 are directly adhered at the adhesion portion brought about by the second adhesive 62. On the contrary, the first flow passage member 21, the vibration film 40, and the protective member 26 exist between the first adhesive 61 and the second flow passage member 22 at the adhesion portion brought about by the first adhesive 61. On this account, in order to absorb the allowable errors of the foregoing three members by the first adhesive 61, the application thickness of the first adhesive 61 in the liquid state is not less than three times the thickness of the adhesive sheet which serves as the layer of the second adhesive 62.

Subsequently, a heater plate 66 is installed on the entire upper surface of the ink supply member 27. The ink supply member 27 is pressed while being heated by the heater plate 66. Accordingly, the first adhesive 61 and the second adhesive 62 are heated and cured respectively, and the ink supply member 27 is adhered to the protective member 26 and the second flow passage member 22. In this case, the layer of the first adhesive 61 is thicker than the layer of the second adhesive 62. Therefore, the force, which is transmitted from the heater plate 66 via the protective member 26 to the first flow passage member 21, is small.

In this case, as depicted in FIG. 8D, it is preferable that the adhesion surface between the ink supply member 27 and the protective member 26 is overlapped in the up-down direction with the wall portion 26*a* which is positioned at the end portion in the left-right direction of the protective member 26. The pressing force, which is allowed to act on the adhesion surface with respect to the protective member 26, is small as compared with adhesion surface with respect to the second flow passage member 22, because the thickness of the layer of the first adhesive 61 is thick. However, the force is still applied to some extent to the protective member 26. In such a situation, if the adhesion surface with respect to the protective member 26 is not overlapped with the wall portion 26*a* described above, i.e., if the ink supply member 27 is adhered to only a central portion in the left-right direction of the protective member 26, then it is feared that the central portion of the protective member 26 may be warped downwardly by the pressing force acting from the ink supply member 27, and the piezoelectric element 41 may be damaged. In relation to this matter, in this embodiment, as depicted in FIG. 8D, the adhesion surface is overlapped with the wall portion 26*a* of the protective member 26. Therefore, the protective member 26 is hardly warped by the pressing force acting from the ink supply member 27.

Note that in FIG. 8D, the ink supply member 27 is adhered to the outer portion in the left-right direction of the protective member 26. However, it is also allowable that the ink supply member 27 is adhered to an inner portion of the protective member 26, and the adhesion surface may be overlapped with the inner wall portion 26*a*. In this case, the volume of the ink supply flow passage 58 in the ink supply member 27 can be widened inwardly. Further, in accordance therewith, the end of the ink supply flow passage 58, which is disposed on the outer side in the left-right direction, can be moved inwardly. As a result, it is possible to decrease the widths in the left-right direction of the ink supply member 27 and the second flow passage member 22 to be adhered thereto.

Figure 9A:
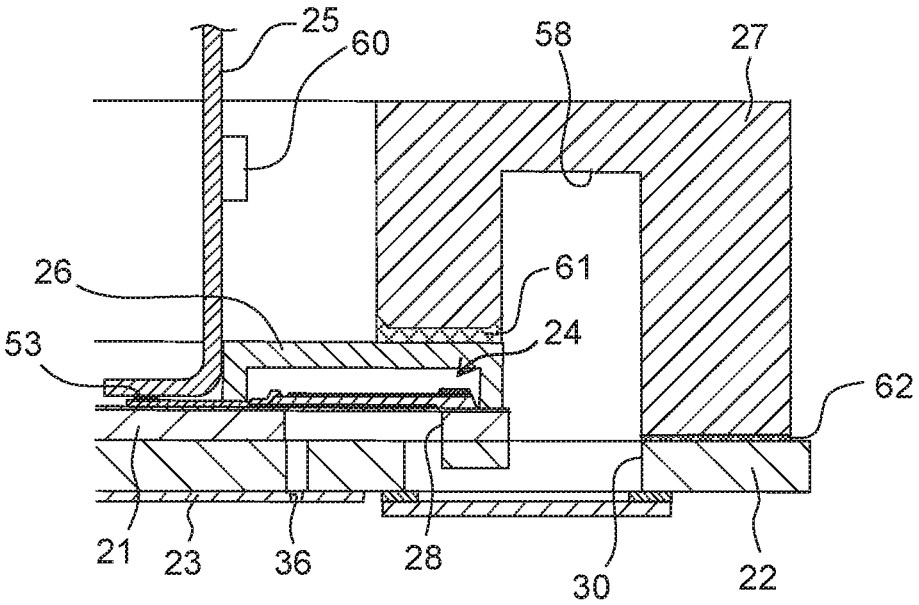
Figure 9B:
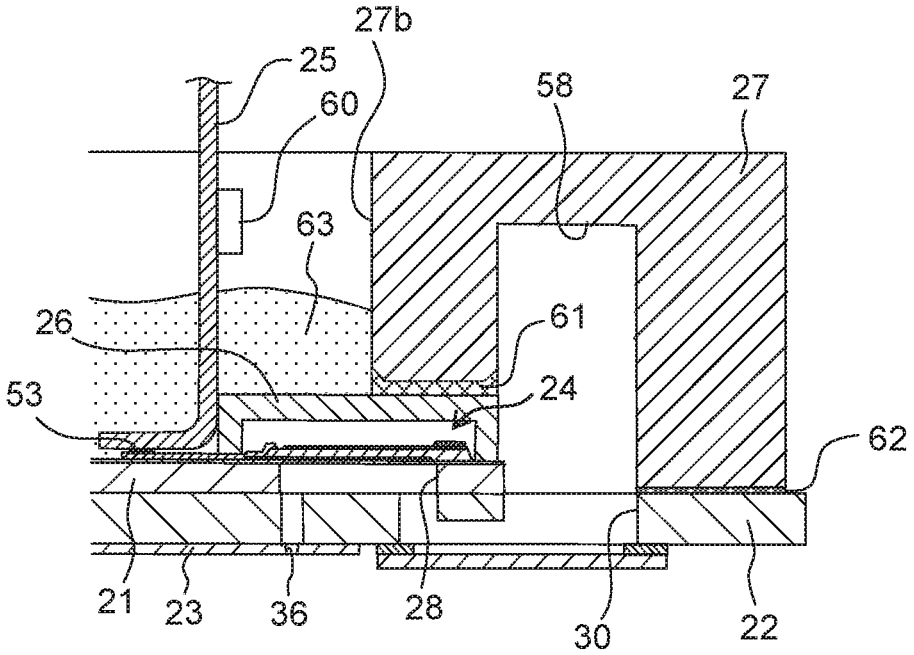

After the ink supply member 27 is adhered, COF 25 is subsequently connected to the driving contacts 53 of the piezoelectric actuator 24 as depicted in FIG. 9A. After that, as depicted in FIG. 9B, the insulative coating material 63 is poured or injected into the hole 27*b* of the ink supply member 27. During this procedure, a sufficient amount of the coating material 63 is charged into the hole 27*b* so that not only the connecting portion between COF 25 and the driving contact 53 but also the adhesion portion brought about by the first adhesive 61 is also covered with the coating material 63.

In the embodiment explained above, the head unit 16 corresponds to the "liquid jetting apparatus" according to the present teaching. The first flow passage member 21 and the second flow passage member 22 correspond to the "flow passage member" according to the present teaching. The opening 30*a* of the manifold 30 corresponds to the "liquid supply port" according to the present teaching. The ink supply member 27 corresponds to the "supply member" according to the present teaching. The conveyance direction corresponds to the "arrangement direction" according to the present teaching.

Next, an explanation will be made about modified embodiments to which various modifications are applied to the embodiment described above. However, those constructed in the same manner as those of the embodiment described above are designated by the same reference numerals, any explanation of which will be appropriately omitted.

First Modified Embodiment

Figure 10:
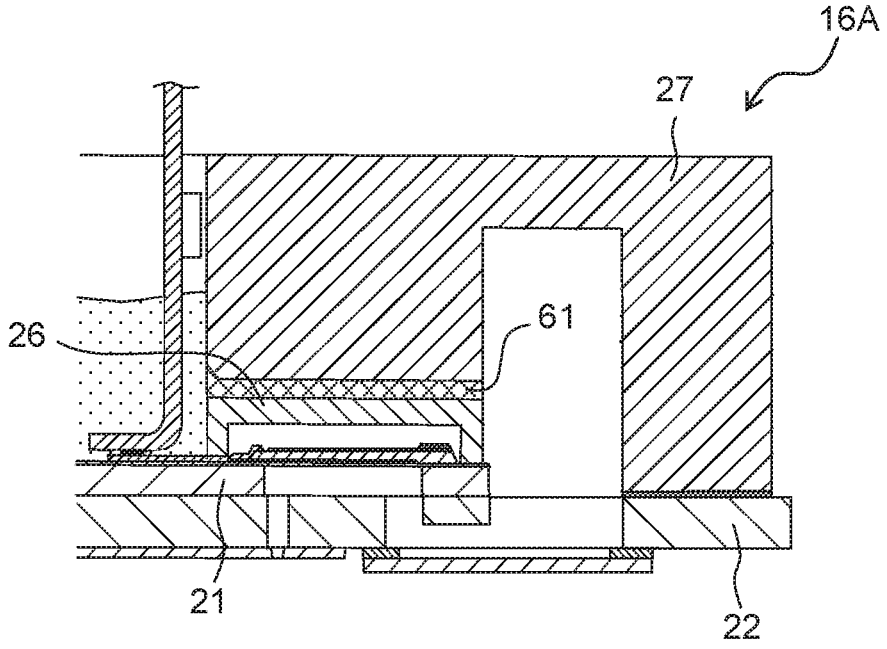
FIG. 10 depicts a sectional view illustrating a head unit according to a first modified embodiment.

As exemplified by a head unit 16A depicted in FIG. 10, it is also allowable that the ink supply member 27 is adhered to the entire region of the upper surface of the protective member 26 disposed on the side opposite to the first flow passage member 21. When the adhesion surface between the protective member 26 and the ink supply member 27 is large, the bulging amount (rising amount), which is provided at the central portion of the adhesion surface, is increased, when the first adhesive 61 is applied to the adhesion surface. Therefore, it is easy to secure the thickness of the layer of the first adhesive 61.

Second Modified Embodiment

The embodiment described above is illustrative of the exemplary case in which the second adhesive 62 is the adhesive sheet. However, it is also allowable that any liquid adhesive is used for both of the first adhesive 61 and the second adhesive 62. In this case, epoxy-based adhesives can be preferably used as the first adhesive 61 and the second adhesive 62 respectively. The first adhesive 61 and the second adhesive 62 may be composed of an identical material, or they may be composed of different materials.

Further, an adhesive, which has a viscosity before the curing larger than a viscosity of the second adhesive 62, may be adopted as the first adhesive 61. When the viscosity before the curing of the first adhesive 61 is high, then the first adhesive 61 hardly spreads during the adhesion, and hence it is easy to secure the thickness. For example, the viscosity of the first adhesive 61 is 100 to 200 cPs, and the viscosity of the second adhesive 62 is 10 to 100 cPs.

Further, the embodiment described above is illustrative of the exemplary case in which the first adhesive is the liquid adhesive which is applied to the upper surface of the protective member. However, it is not necessarily indispensable that the first adhesive should be the liquid adhesive. The first adhesive may be an adhesive sheet.

Third Modified Embodiment

Figure 11:
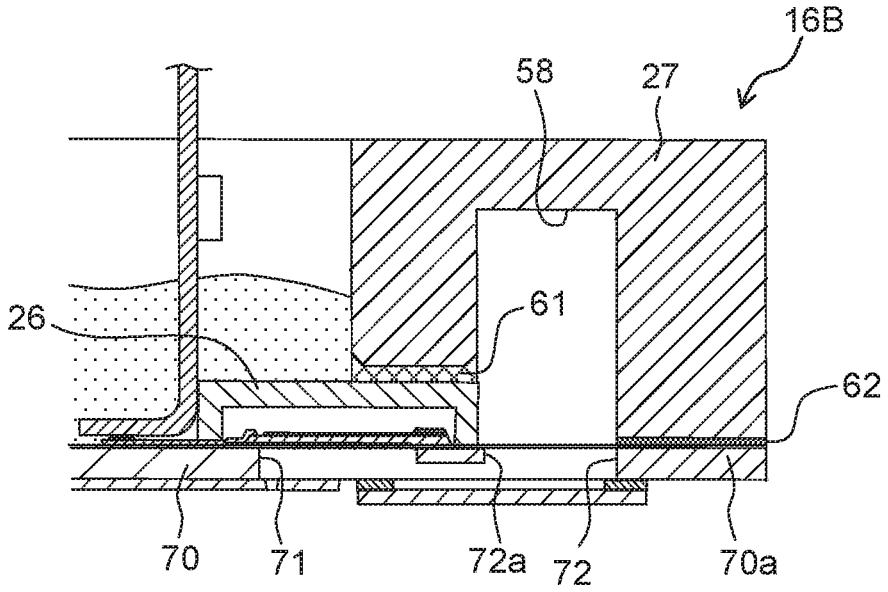
FIG. 11 depicts a sectional view illustrating a head unit according to a third modified embodiment.

In the embodiment described above, the flow passage member, to which the ink is supplied from the ink supply member 27, is divided into the first flow passage member 21 and the second flow passage member 22. However, there is no limitation to the embodiment as described above. In the case of a head unit 16B depicted in FIG. 11, one flow passage member 70 is formed with a plurality of pressure chambers 71 and a manifold 72. The flow passage member 70 depicted in FIG. 11 has a portion 70*a* which extends outwardly in the left-right direction from a portion at which the pressure chamber 71 is formed. An opening 72*a* of the manifold 72 is formed at the outer portion 70*a*. On that basis, the ink supply member 27 is adhered to the protective member 26 by means of the first adhesive 61, and the ink supply member 27 is adhered to the outer portion 70*a* of the flow passage member 70 by means of the second adhesive 62.

Fourth Modified Embodiment

Figure 12:
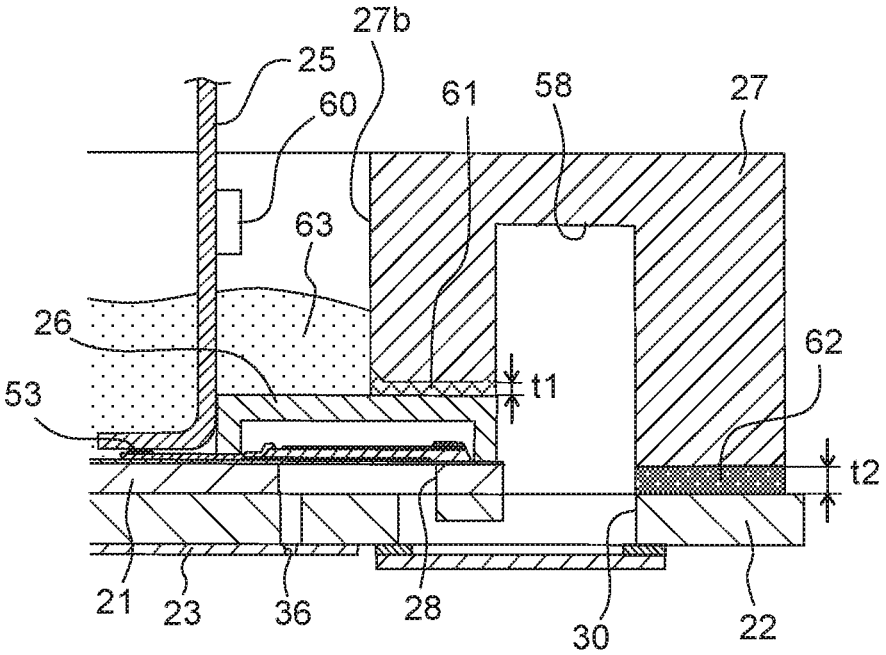
FIG. 12 depicts a sectional view illustrating a head unit according to a fourth modified embodiment.

In the embodiment described above, the thickness t1 of the layer of the first adhesive 61 is thicker than the thickness t2 of the layer of the second adhesive 62. However, there is no limitation to the embodiment as described above. On condition that the influence of the pressing force acting on the piezoelectric element 41 via the protective member 26 can be made small when the ink supply member 27 is adhered while extending over the second flow passage member 22 and the protective member 26, it is also allowable that the thickness t1 of the layer of the first adhesive 61 is thinner than the thickness t2 of the layer of the second adhesive 62 as depicted in FIG. 12. That is, it is enough that the thickness t1 of the layer of the first adhesive 61 is different from the thickness t2 of the layer of the second adhesive 62.

Fifth Modified Embodiment

Figure 13:
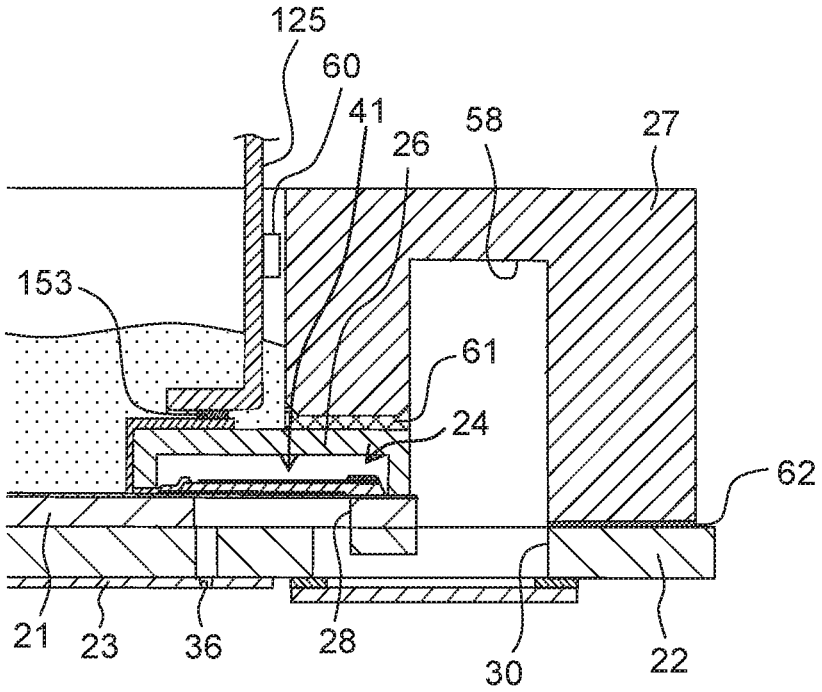
FIG. 13 depicts a sectional view illustrating a head unit according to a fifth modified embodiment.

In the embodiment described above, the plurality of driving contacts 53 are provided in the area of the vibration film 40 disposed between the two piezoelectric element arrays. However, there is no limitation to the embodiment as described above. For example, as depicted in FIG. 13, driving contacts 153 may be provided on the upper surface of the protective member 26, i.e., on the surface disposed on the side opposite to the piezoelectric element 41, and COF 125 may be connected to the driving contacts 153 on the upper surface of the protective member 26. In this case, the position of the driving contact 153 is near to the ink supply flow passage 58 of the ink supply member 27 as compared with the embodiment described above. Therefore, in order that the ink contained in the ink supply flow passage 58 hardly leaks from the adhesion portion brought about by the first adhesive 61, it is desirable that the adhesion area brought about by the first adhesive 61 is secured to be as large as possible.

In the embodiments explained above, the present teaching is applied to the ink-jet head for printing an image or the like by jetting the ink onto the recording paper. However, the present teaching is also applicable to any liquid jetting apparatus or apparatus which is used for various ways of use other than the printing of the image or the like. For example, the present teaching can be also applied to a liquid jetting apparatus or apparatus for jetting a conductive liquid onto a substrate to form a conductive pattern on a surface of the substrate.

What is claimed is:

1. A liquid jetting apparatus comprising:

a flow passage member having a pressure chamber communicated with a nozzle and a liquid supply port communicated with the pressure chamber;

a piezoelectric element provided on the flow passage member to overlap with the pressure chamber;

a protective member arranged on the flow passage member to cover the piezoelectric element; and a supply member formed with a supply flow passage communicated with the liquid supply port of the flow passage member, and adhered to the flow passage member and the protective member to extend over the flow passage member and the protective member, and wherein a thickness of a layer of a first adhesive adhering the protective member and the supply member is different from a thickness of a layer of a second adhesive adhering the flow passage member and the supply member, wherein the first adhesive is in a liquid state and the second adhesive is an adhesive sheet.

2. The liquid jetting apparatus according to claim 1, wherein the thickness of the layer of the first adhesive is not less than 5 μm and the thickness of the layer of the second adhesive is 1 μm to 3 μm.

3. The liquid jetting apparatus according to claim 1, further comprising:

a contact arranged in an area of the flow passage member adjacent to the protective member, and connected to the piezoelectric element; and a wiring member having a connecting portion connected to the contact, wherein an insulative coating material is provided to cover the connecting portion of the wiring member.

4. The liquid jetting apparatus according to claim 1, further comprising:

a contact arranged on a surface of the protective member disposed on a side opposite to the piezoelectric element, and connected to the piezoelectric element; and a wiring member having a connecting portion connected to the contact, wherein an insulative coating material is provided to cover the connecting portion of the wiring member.

5. The liquid jetting apparatus according to claim 1, wherein the pressure chamber is provided as pressure chambers, the pressure chambers are arranged in an arrangement direction along a predetermined arrangement plane, and the supply member is adhered to the flow passage member and the protective member to extend over the flow passage member and the protective member at an end portion of the flow passage member in the arrangement direction.

6. The liquid jetting apparatus according to claim 1, wherein the flow passage member includes:

a first flow passage member which is formed with the pressure chamber and on which the piezoelectric element is arranged; and a second flow passage member which is arranged on a side opposite to the piezoelectric element with respect to the first flow passage member and which has the liquid supply port formed at a protruding portion protruding from the first flow passage member, the protective member is arranged to cover the piezoelectric element on a side of the first flow passage member opposite to the second flow passage member, and the supply member is adhered to the protective member and the protruding portion of the second flow passage member to extend over the protective member and the protruding portion of the second flow passage member.

7. A liquid jetting apparatus comprising:

a flow passage member having a pressure chamber communicated with a nozzle and a liquid supply port communicated with the pressure chamber;

a piezoelectric element provided on the flow passage member to overlap with the pressure chamber;

a protective member arranged on the flow passage member to cover the piezoelectric element; and a supply member formed with a supply flow passage communicated with the liquid supply port of the flow passage member, and adhered to the flow passage member and the protective member to extend over the flow passage member and the protective member, wherein a thickness of a layer of a first adhesive adhering the protective member and the supply member is different from a thickness of a layer of a second adhesive adhering the flow passage member and the supply member, an adhesion surface between the protective member and the supply member has a surface roughness which is greater than that of an adhesion surface between the flow passage member and the supply member, wherein the adhesion surface between the protective member and the supply member comprises a surface of the protective member and a surface of the supply member and wherein the adhesion surface between the flow passage member and the supply member comprises a surface of the flow passage member and a surface of the supply member.

8. The liquid jetting apparatus according to claim 7, wherein the thickness of the layer of the first adhesive is not less than 5 μm and the thickness of the layer of the second adhesive is 1 μm to 3 μm.

9. The liquid jetting apparatus according to claim 7, further comprising:

a contact arranged in an area of the flow passage member adjacent to the protective member, and connected to the piezoelectric element; and a wiring member having a connecting portion connected to the contact, wherein an insulative coating material is provided to cover the connecting portion of the wiring member.

10. The liquid jetting apparatus according to claim 7, further comprising:

a contact arranged on a surface of the protective member disposed on a side opposite to the piezoelectric element, and connected to the piezoelectric element; and a wiring member having a connecting portion connected to the contact, wherein an insulative coating material is provided to cover the connecting portion of the wiring member.

11. The liquid jetting apparatus according to claim 7, wherein the pressure chamber is provided as pressure chambers, the pressure chambers are arranged in an arrangement direction along a predetermined arrangement plane, and the supply member is adhered to the flow passage member and the protective member to extend over the flow passage member and the protective member at an end portion of the flow passage member in the arrangement direction.

12. The liquid jetting apparatus according to claim 7, wherein the flow passage member includes:

a first flow passage member which is formed with the pressure chamber and on which the piezoelectric element is arranged; and a second flow passage member which is arranged on a side opposite to the piezoelectric element with respect to the first flow passage member and which has the liquid supply port formed at a protruding portion protruding from the first flow passage member, the protective member is arranged to cover the piezoelectric element on a side of the first flow passage member opposite to the second flow passage member, and the supply member is adhered to the protective member and the protruding portion of the second flow passage member to extend over the protective member and the protruding portion of the second flow passage member.

13. The liquid jetting apparatus according to claim 7, wherein the surface roughness of the adhesion surface between the protective member and the supply member is not less than 1.0 μm and the surface roughness of the adhesion surface between the flow passage member and the supply member is less than 1.0 μm.

* * * * *